US009193172B2

(12) United States Patent
Morimoto et al.

(10) Patent No.: US 9,193,172 B2
(45) Date of Patent: Nov. 24, 2015

(54) PRINTER AND CONTROL METHOD

(71) Applicant: Kabushiki Kaisha Toshiba, Minato-ku (JP)

(72) Inventors: Fumitoshi Morimoto, Shirakawa (JP); Nobuki Nemoto, Kawasaki (JP); Takeo Miki, Machida (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 14/631,043

(22) Filed: Feb. 25, 2015

(65) Prior Publication Data

US 2015/0258809 A1 Sep. 17, 2015

(30) Foreign Application Priority Data

Mar. 14, 2014 (JP) ..... 2014-051721

(51) Int. Cl.
*B41J 2/365* (2006.01)
*B41J 2/355* (2006.01)

(52) U.S. Cl.
CPC . *B41J 2/355* (2013.01); *B41J 2/365* (2013.01)

(58) Field of Classification Search
USPC ..... 347/188, 189, 194; 400/120.09, 120.14
See application file for complete search history.

(56) References Cited

U.S. PATENT DOCUMENTS 5,142,302 A * 8/1992 Kano ..... 347/172
2007/0273723 A1* 11/2007 Tsuchikawa ..... 347/17

FOREIGN PATENT DOCUMENTS

JP 04-319450 * 11/1992 ..... B41J 2/365
JP 2009-078385 A 4/2009

OTHER PUBLICATIONS

English translation of JP 4-319450, published on Nov. 1992.*

* cited by examiner

*Primary Examiner* — Huan Tran
(74) *Attorney, Agent, or Firm* — Oblon, McClelland, Maier & Neustadt, L.L.P.

(57) ABSTRACT

According to one embodiment, a printer includes a printing portion to perform printing using a thermal head, a first detecting portion to detect a first temperature that is a head temperature of the thermal head, a second detecting portion to detect a second temperature that is an ambient temperature of the thermal head, and a controller which reads, from a memory portion to store control conditions of the thermal head, each of which is determined for each of the head temperatures under the one ambient temperature, the control condition corresponding to an effective head temperature based on the first temperature and the second temperature, and controls the thermal head in accordance with the relevant read control condition.

3 Claims, 5 Drawing Sheets

| SECOND TEMPERATURE (°C) \ FIRST TEMPERATURE (°C) | 0 | 1 | ··· | 25 | 26 | 27 | ··· | 62 | 63 |
|---|---|---|---|---|---|---|---|---|---|
| 0 | 1:1 | 1:1 | | 1:2 | 1:2 | 1:2 | | 1:3 | 1:3 |
| 1 | 1:1 | 1:1 | | 1:2 | 1:2 | 1:2 | | 1:3 | 1:3 |
| ··· | | | | | | | | | |
| 25 | 1:2 | 1:2 | | 1:1 | 1:1 | 1:1 | | 1:2 | 1:2 |
| 26 | 1:2 | 1:2 | | 1:1 | 1:1 | 1:1 | | 1:2 | 1:2 |
| 27 | 1:2 | 1:2 | | 1:1 | 1:1 | 1:1 | | 1:2 | 1:2 |
| ··· | | | | | | | | | |
| 62 | 1:3 | 1:3 | | 1:2 | 1:2 | 1:2 | | 1:1 | 1:1 |
| 63 | 1:3 | 1:3 | | 1:2 | 1:2 | 1:2 | | 1:1 | 1:1 |

FIG. 8

PRINTER AND CONTROL METHOD

CROSS-REFERENCE TO RELATED APPLICATION

This application is based upon and claims the benefit of priority from Japanese Patent Application No. 2014-051721, filed on Mar. 14, 2014; the entire contents of which are incorporated herein by reference.

FIELD

Embodiments described herein relate generally to a printer and a control method of a printer.

BACKGROUND

As a method of recording a face image and characters to a recording medium such as a bankbook and a card for personal identification in a financial institution such as a bank, there is a melting type thermal transfer recording method. In the case of recording characters to a recording medium using a melting type thermal transfer recording method, recording of a two-gradation image (binary image) may be performed. But in the case of recording a face image to a recording medium, since recording is performed using an area gradation method which changes a size of a dot to be transferred to the recording medium, it becomes necessary to practice various measures.

For example, there is an art which selects an optimum print parameter (an example of a control condition), based on an environmental temperature (ambient temperature) of a thermal head to be used in a melting type thermal transfer recording method, and a head temperature of the relevant thermal head, and controls the thermal head in accordance with the selected print parameter, to perform recording to a recording medium with a stable print density.

By the way, in a conventional art, print parameters for respective head temperatures are stored, in the case in which environmental temperatures of a thermal head and head temperatures of the thermal head are respectively same, and the thermal head is controlled using a print parameter corresponding to a detected head temperature of the thermal head, and thereby printing is performed with a stable print density. For the reason, when the difference between an environmental temperature and a head temperature of the thermal head becomes large, the difference between a detected head temperature of the thermal head and an effective head temperature becomes also large, and thereby it is not possible to perform printing with a stable print density.

Therefore, a method is also considered in which print parameters of all combinations of environmental temperatures of a thermal head and head temperatures of the thermal head are stored, and which controls the thermal head using a print parameter corresponding to the combination of an environmental temperature of the thermal head and a head temperature which have been detected, to perform printing with a stable print density. However, in order to store print parameters for the environmental temperatures from 0° C. to 63° C. in increments of 1° C., for respective head temperatures, it is necessary to provide a memory which can store print parameters that are 64 times as large as the present print parameters on a board.

BRIEF DESCRIPTION OF THE DRAWINGS

FIG. 8 is a diagram for explaining a reading processing of a print parameter in the printer according to the present embodiment.

DETAILED DESCRIPTION

According to one embodiment, there is provided a printer including: a printing portion to perform printing using a thermal head; a first detecting portion to detect a first temperature that is a head temperature of the thermal head; a second detecting portion to detect a second temperature that is an ambient temperature of the thermal head; a memory portion to store control conditions of the thermal head, each of which is determined for each of the head temperatures under the one ambient temperature; and a controller which reads the control condition corresponding to an effective head temperature based on the first temperature and the second temperature, from the memory portion, and controls the thermal head in accordance with the relevant read control condition.

Hereinafter, a printer and a control method according to a present embodiment will be described with reference to the accompanying drawings.

Figure 1:
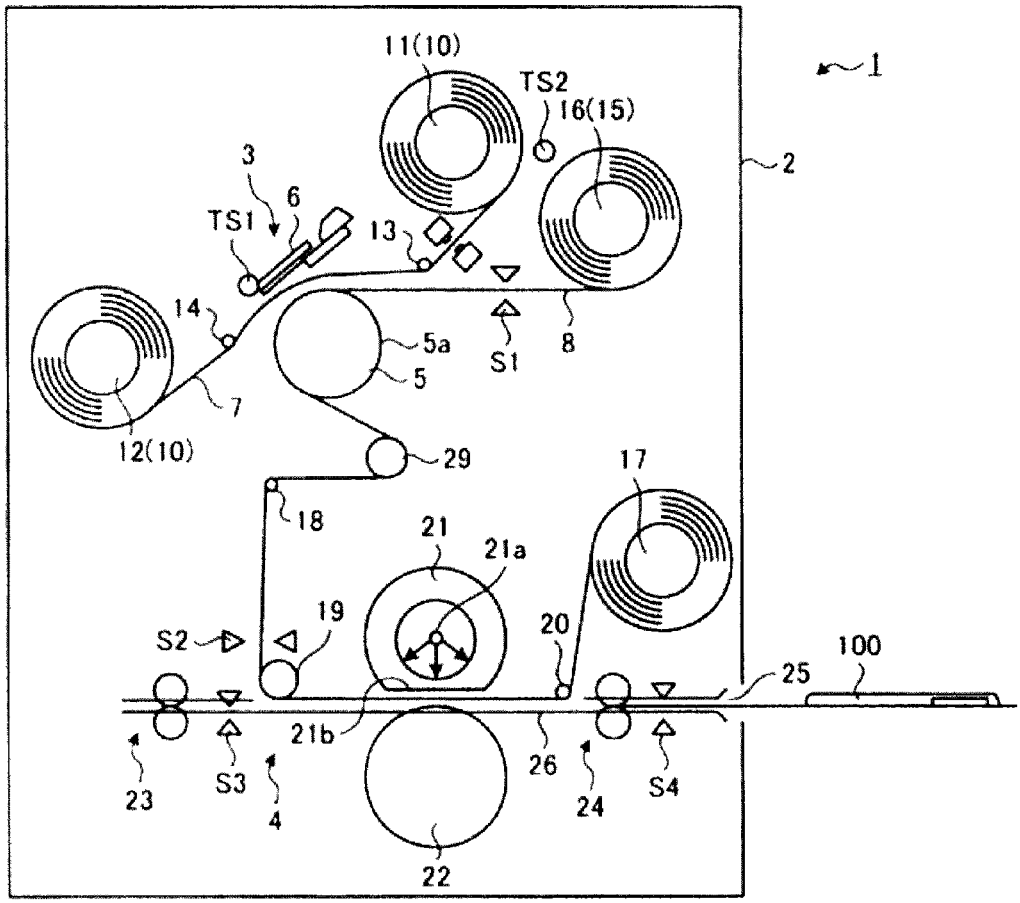
FIG. 1 is a diagram showing a schematic configuration of a printer according to a present embodiment.

FIG. 1 is a diagram showing a schematic configuration of a printer according to the present embodiment. A printer 1 according to the present embodiment is provided with a chassis 2, as shown in FIG. 1. A printing portion 3 and a transferring portion 4 and so on are housed in the chassis 2.

The printing portion 3 performs printing with a heat melting type printing system. Specifically, the printing portion 3 has a platen roller 5 and a thermal head 6 arranged opposite to the platen roller 5. A thermal transfer ink ribbon 7 and an intermediate transfer film 8 which are mutually overlapped are supplied (interposed) between the platen roller 5 and the thermal head 6.

In the printing portion 3, the thermal head 6 heats the thermal transfer ink ribbon 7 and transfers the ink of the thermal transfer ink ribbon 7 to a surface (a face) of the intermediate transfer film 8, to print a face image, an image of various information or the like on the surface of the intermediate transfer film 8. In a heat melting type printing system, since the durability of an image is high, and it is comparatively easy to apply functional material (fluorescent pigment and an aluminium evaporated thin film, for example) to ink material, a falsification prevention effect is exhibited, as an example. For this reason, a heat melting type printing system is suited for printing to a print media (information media) requiring high security, such as an identification card, as an example.

In FIG. 1, as a matter of convenience, the thermal transfer ink ribbon 7 and the intermediate transfer film 8 are shown separately, between the platen roller 5 and the thermal head 6. But actually, the thermal transfer ink ribbon 7 and the intermediate transfer film 8 become in a contacted state, between the platen roller 5 and the thermal head 6.

The platen roller 5 is rotatably coupled to the chassis 2. The platen roller 5 supports the intermediate transfer film 8, with an outer surface 5*a* coming in contact with the intermediate transfer film 8 which moves while being overlapped with the thermal transfer ink ribbon 7.

The thermal head 6 has a plurality of heater elements arranged in a line, as an example. The heater elements which the thermal head 6 has come in contact with the thermal transfer ink ribbon 7. The thermal head 6 makes the heater element contacting the thermal transfer ink ribbon 7 selectively generate heat, to heat the thermal transfer ink ribbon 7. The thermal head 6 is fitted to the chassis 2 via a coupling mechanism not shown.

In the thermal transfer ink ribbon 7 (heat melting ink ribbon, transfer ribbon), as a plurality of heat melting ink layers, an yellow ink layer, a magenta ink layer, a cyan ink layer, and a black ink layer are formed repeatedly on one surface of a long (belt-like) support, in line of this order, as an example. The arrangement order of the respective ink layers may be an order other than the above-described order.

The thermal transfer ink ribbon 7 is supplied between the platen roller 5 and the thermal head 6 by an ink ribbon supplying portion 10 (supplying portion). The ink ribbon supplying portion 10 has a delivery shaft 11 (shaft, core) around which one end portion of the thermal transfer ink ribbon 7 is wound, and a winding shaft 12 (shaft, core) around which the other end portion of the thermal transfer ink ribbon 7 is wound, as an example. In the ink ribbon supplying portion 10, the winding shaft 12 which is rotation-driven by a motor (driving source) not shown winds the thermal transfer ink ribbon 7 which has been sent from the delivery shaft 11 and has passed through between the platen roller 5 and the thermal head 6, as an example. In addition, in the present embodiment, the thermal transfer ink ribbon 7 located between the delivery shaft 11 and the winding shaft 12 are wound over guide shafts 13, 14.

In the intermediate transfer film 8 (intermediate transfer medium, intermediate transfer ribbon), on one face of a long (belt-like) support, a release layer made of wax and so on, a protective layer made of resin, an image receiving and adhesive layer are formed in order, as an example.

The intermediate transfer film 8 is supplied between the platen roller 5 and the thermal head 6 by a film supplying portion 15 (supplying portion). The film supplying portion 15 has a delivery shaft 16 (shaft, core) around which one end portion of the intermediate transfer film 8 is wound, and a winding shaft 17 (shaft, core) around which the other end portion of the intermediate transfer film 8 is wound, as an example. In the film supplying portion 15, the winding shaft 17 which is rotation-driven by a motor (driving source) not shown winds the intermediate transfer film 8 which has been sent from the delivery shaft 16 and has passed through between the platen roller 5 and the thermal head 6, as an example. In addition, in the present embodiment, the intermediate transfer film 8 located between the delivery shaft 16 and the winding shaft 17 are wound over guide shafts 18-20, and wound over a tension roller 29, and is maintained to an approximately constant tension.

The transferring portion 4 has a heat roller 21 (transfer roller), and a backup roller 22 arranged opposite to the heat roller 21. The heat roller 21 and the backup roller 22 are arranged at the downstream of the platen roller 5 and the thermal head 6, in the moving direction of the intermediate transfer film 8. By this means, the intermediate transfer film 8 on which an image has been formed by the printing portion 3 is interposed between the heat roller 21 and the backup roller 22.

The heat roller 21 incorporates a heater 21*a* for heating. The heat roller 21 heats the intermediate transfer film 8 with the heat generated by the heater 21*a*. In addition, the heat roller 21 has a cut surface 21*b* that is a plane provided at a part of the outer surface around a shaft of the relevant heat roller 21.

In addition, the transferring portion 4 has conveyor roller pairs 23, 24. The heat roller 21 and the backup roller 22 are arranged between the conveyor roller pairs 23, 24. The conveyor roller pairs 23, 24 convey a print media 100 inserted from a print media intake port 25 to a transfer position by the heat roller 21 along a media conveying path 26.

In the transferring portion 4, the heat roller 21 heats the intermediate transfer film 8 overlapped on the printing surface of the print media 100 which has been conveyed to the transfer position, to transfer an image (ink) on the intermediate transfer film 8 to the printing surface of the print media 100. By this means, the image is formed on the printing surface of the print media 100.

In addition, the printer 1 has sensors S1, S2 arranged along the moving route of the intermediate transfer film 8. Each of the sensors S1, S2 optically detects a bar mark arranged outside an effective area in the intermediate transfer film 8 that is an area to which ink is to be transferred.

In addition, the printer 1 has sensors S3, S4 arranged along the media conveying path 26 of the print media 100. Each of the sensors S3, S4 optically detects the presence or absence of the print media 100 inserted from the print media intake port 25.

Further, the printer 1 has a first thermistor TS1 which is attached to the thermal head 6 and is used for detecting a first temperature that is a head temperature of the relevant thermal head 6, and a second thermistor TS2 which is provided in the vicinity (in the present embodiment, a position where the thermal transfer ink ribbon 7 is sent out from the delivery shaft 11) of the thermal head 6 and is used for detecting a second temperature that is an ambient temperature of the relevant thermal head 6.

In addition, the printer 1 is provided with a controller 200 described later. Using the detection result of the positions of the print media 100, the thermal transfer ink ribbon 7 and the intermediate transfer film 8 by the sensors S1, S2, S3, S4, and the detection result of the first temperature and the second temperature using the first thermistor TS1 and the second thermistor TS2, the controller 200 controls the operation of the respective portions of the printer 1, to perform printing processing.

Figure 2:
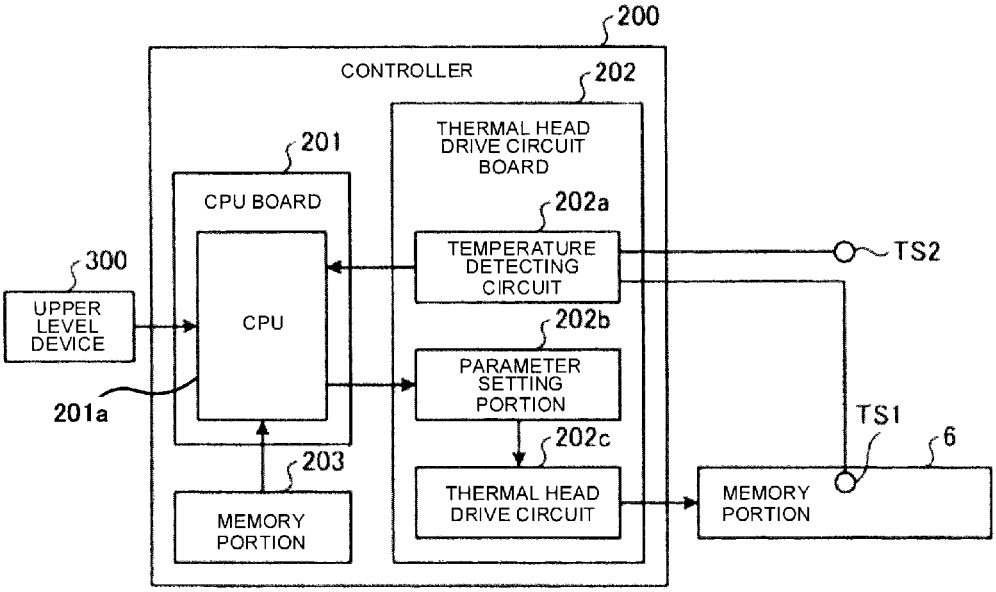
FIG. 2 is a diagram showing a hardware configuration of the printer according to the present embodiment.

Next, a hardware configuration of the printer 1 according to the present embodiment will be described using FIG. 2. FIG. 2 is a diagram showing a hardware configuration of the printer according to the present embodiment. The printer 1 according to the present embodiment has the controller 200 which controls the whole of the relevant printer 1, as shown in FIG. 2. The controller 200 has a CPU (Central Processing Unit) board 201, a thermal head drive circuit board 202, a memory portion 203.

The memory portion 203 is composed of a ROM (Read Only Memory) and so on, and stores a control program used for controlling the printer 1, and various information such as print parameters (an example of a control condition) used for controlling the thermal head 6. Specifically, the memory portion 203 stores print parameters each of which is used for controlling the thermal head 6, for each head temperature of the thermal head 6, under one ambient temperature.

Figure 3:
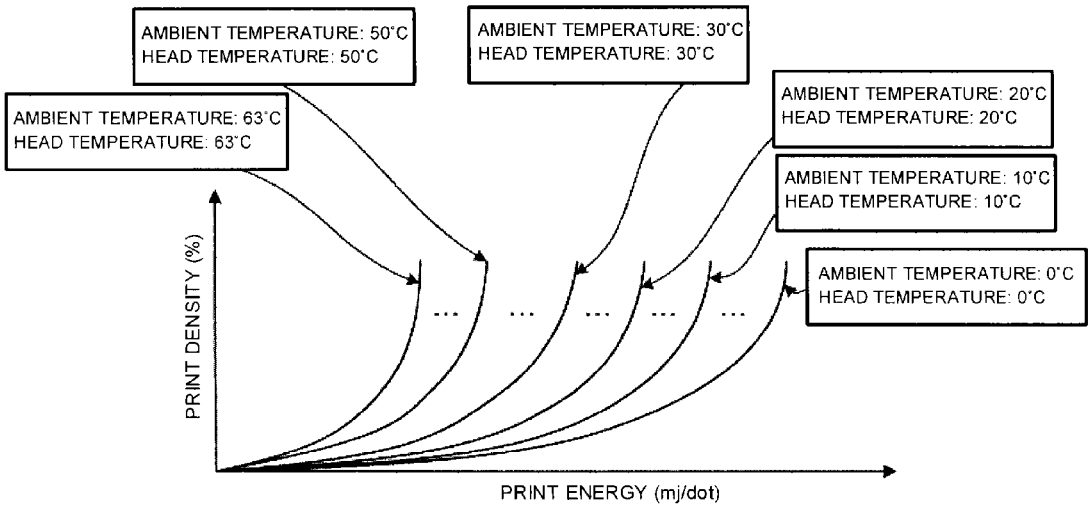
FIG. 3 is a diagram showing print parameters stored in the memory portion which the printer according to the present embodiment has.

FIG. 3 is a diagram showing print parameters stored in the memory portion which the printer according to the present embodiment has. As shown in FIG. 3, the memory portion 203 stores print parameters (in the present embodiment, a print energy for each print density of an image to be printed), each of which is determined, for each head temperature (in the present embodiment, the head temperatures between 0-63° C., in increments of 1° C.), in the case in which the ambient temperature of the thermal head 6 is identical to the head temperature. Here, the print energy (mj/dot) is energy required for transferring (printing) a print dot.

In the present embodiment, the memory portion 203 stores the print parameters, each of which is determined for each head temperature, in the case in which the ambient temperature of the thermal head 6 is identical to the head temperature. But it is only necessary that the memory portion 203 stores print parameters, each of which is determined for each head temperature of the thermal head 6, under one ambient temperature. For example, the memory portion 203 may store print parameters, each of which is determined for each head temperatures, in the case in which the ambient temperature of the thermal head 6 and the head temperature are different (for example, the ambient temperature of the thermal head 6 is lower than the head temperature by a prescribed temperature). By this means, it is only necessary that one set of print parameters is stored in the memory portion 203 for each head temperature, and thereby it is possible to reduce a memory area of the memory portion 203 necessary for storing the print parameters.

Returning to FIG. 2, the CPU board 201 has a CPU 201*a*. The CPU 201*a* executes the control program stored in the memory portion 203, to execute various processings, such as the above-described print processing. When executing the print processing, the CPU 201*a* acquires the first temperature and the second temperature which have been detected using the first thermistor TS1 and the second thermistor TS2, from the thermal head drive circuit board 202. Next, the CPU 201*a* obtains an effective head temperature of the thermal head 6, based on the acquired first temperature and second temperature. And, the CPU 201*a* reads a print parameter corresponding to the obtained effective head temperature from the memory portion 203, and sends the read print parameter to the thermal head drive circuit board 202. In addition, in the present embodiment, the CPU 201*a* can communicate with an upper level device 300 via a network such as Internet.

The thermal head drive circuit board 202 controls the thermal head 6, in accordance with the print parameter received from the CPU 201*a*, to transfer an image based on print data (image data) of the transfer (print) target to the print media 100 via the intermediate transfer film 8. That is, in the present embodiment, the CPU 201*a* and the thermal head drive circuit board 202 function as a control portion which reads the print parameter corresponding to the effective head temperature based on the first temperature and the second temperature from the memory portion 203, and controls the thermal head 6 in accordance with the relevant read print parameter.

In the present embodiment, the thermal head drive circuit board 202 has a temperature detecting circuit 202*a* which detects the first temperature and the second temperature using the first thermistor TS1 and the second thermistor TS2, and outputs the detected temperatures to the CPU 201*a*, a parameter setting portion 202*b* which sets the print parameter received from the CPU 201*a* to a thermal head drive circuit 202*c* described later, and controls heating operation of heater elements which the thermal head 6 has, in accordance with the print parameter set by the relevant parameter setting portion 202*b*. In the present embodiment, the first thermistor TS1 and the temperature detecting circuit 202*a* function as a first detecting portion to detect the first temperature, and the second thermistor TS2 and the temperature detecting circuit 202*a* function as a second detecting portion to detect the second temperature.

Figure 4:
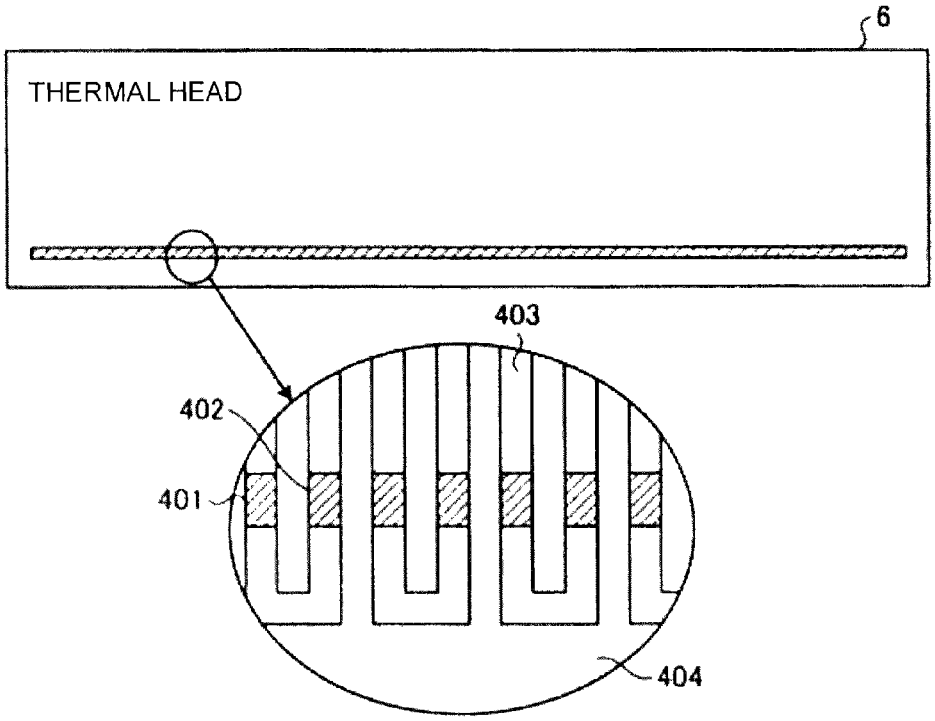
FIG. 4 is a diagram showing a schematic configuration of the thermal head which the printer according to the present embodiment has.

FIG. 4 is a diagram showing a schematic configuration of the thermal head which the printer according to the present embodiment has. In the present embodiment, as shown in FIG. 4, the thermal head 6 has heater elements (heating resistors) 401, 402, an electrode 403 and a folding back electrode 404 that are electrically connected to the relevant heater elements 401, 402, which are arranged on a rectangular support board not shown in the long direction (a direction perpendicular to the conveying direction of the print media 100, hereinafter called a main scanning direction) of the relevant support board.

In the present embodiment, a pair of adjacent heater elements 401, 402 functions as a print dot heat generating portion to transfer one print dot to the intermediate transfer film 8. The electrode 403 is provided for each of the print dot heating generating portions, and is formed toward the conveying direction (hereinafter, called a sub scanning direction) of the print media 100. The folding back electrode 404 is provided for each of the print dot heat generating portions, and is formed into a nearly U-shape.

When performing print processing, the thermal head drive circuit board 202 applies a voltage to the electrode 403 in accordance with the print parameter received from the CPU 201*a*, to flow currents to the heater elements 401, 402 in the opposite directions, and thereby makes the heater elements 401, 402 generate heat. By means of this, the thermal head drive circuit board 202 heats the heat transfer ink ribbon 7, to make the ink layer of the relevant heat transfer ink ribbon 7 to be melted, and thereby transfers an image to the intermediate transfer film 8.

Figure 5:
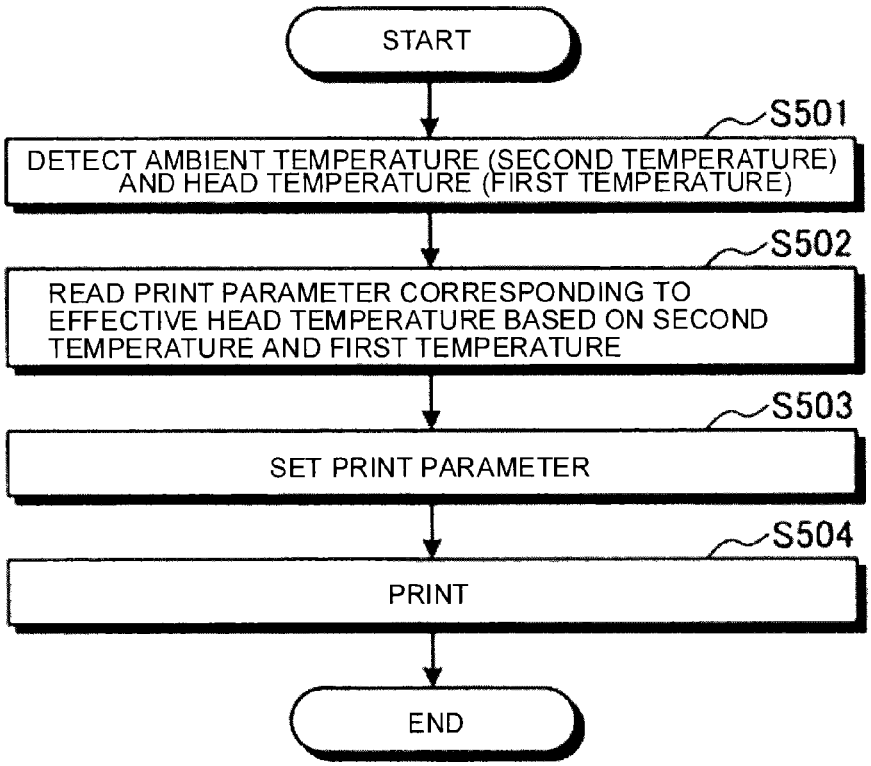
FIG. 5 is a flow chart showing a flow of a print processing in the printer according to the present embodiment.

Next, a flow of a print processing in the printer 1 according to the present embodiment will be described, using FIG. 5. FIG. 5 is a flow chart showing a flow of a print processing in the printer according to the present embodiment.

When a printing start instruction is inputted to the CPU 201*a* from an operation unit, and so on not shown which the printer 1 is provided with, the CPU 201*a* instructs the temperature detecting circuit 202*a* to detect the first temperature and the second temperature. When being instructed to detect the first temperature and the second temperature from the CPU 201*a*, the temperature detecting circuit 202*a* detects the first temperature and the second temperature using the first thermistor TS1 and the second thermistor TS2, and outputs the detected temperatures to the CPU 201*a* (step S501).

When the detection result of the first temperature and the second temperature is inputted to the CPU 201*a* from the temperature detecting circuit 202*a*, the CPU 201*a* calculates an effective head temperature based on the inputted first temperature and second temperature. Then, the CPU 201*a* reads a print parameter corresponding to the calculated effective head temperature from the memory portion 203, and outputs the read print parameter to the parameter setting portion 202*b* (step S502). In the present embodiment, the CPU 201*a* reads the print parameter from the memory portion 203 which the printer 1 is provided with. But without being limited to this, the print parameter may be read from an external storage device provided in the upper level device 300, such as a server connected via a network such as Internet, for example. In such a case, it is supposed that the print parameters, each of which is used for the control of the thermal head 6, for each head temperature of the thermal head 6, under one ambient temperature, are stored in the external storage device which the upper level device 300 has, in the same manner as the memory portion 203.

The parameter setting portion 202*b* sets the print parameter outputted from the CPU 201*a* to the thermal head drive circuit 202*c* (step S503). The thermal head drive circuit 202*c* controls the thermal head 6 in accordance with the print parameter which has been set by the parameter setting portion 202*b*, to execute the print processing to transfer an image based on the print data of the transfer target to the intermediate transfer film 8 (step S504).

Figure 6:
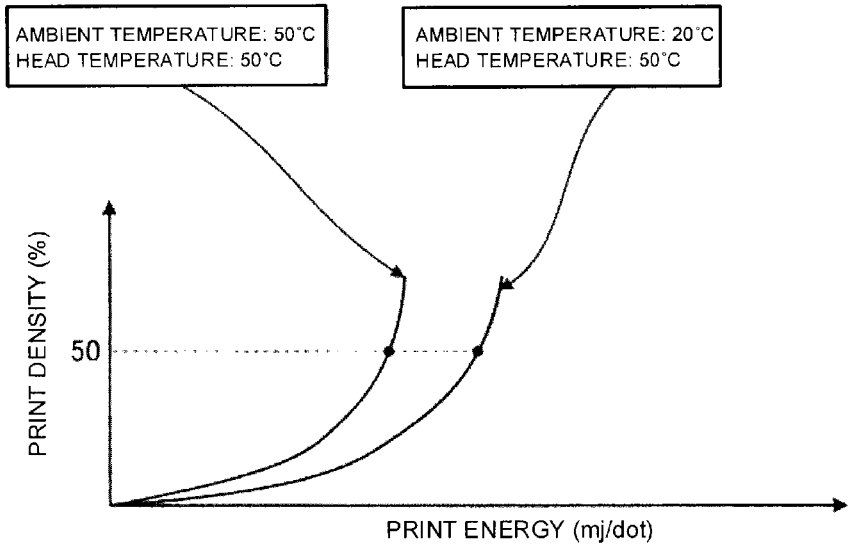
FIG. 6 is a diagram for explaining a reading processing of a print parameter in a conventional printer.
Figure 7:
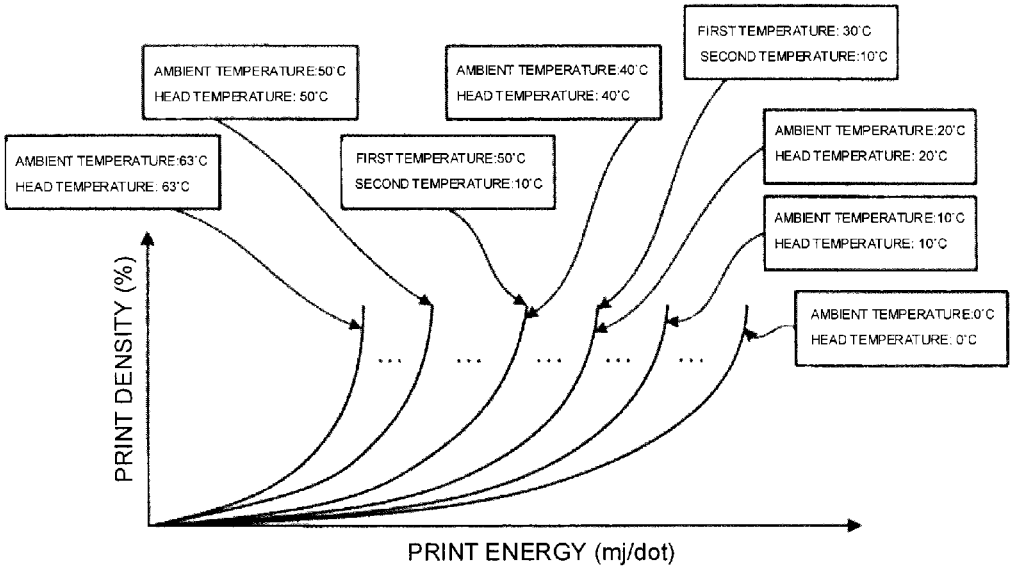
FIG. 7 is a diagram for explaining a calculation method of an effective head temperature in the printer according to the present embodiment.

Next, a reading (selection) processing of a print parameter in the printer 1 according to the present embodiment will be described in detail, using FIGS. 6-8. FIG. 6 is a diagram for explaining a reading processing of a print parameter in a conventional printer. FIG. 7 is a diagram for explaining a calculation method of an effective head temperature in the printer according to the present embodiment. FIG. 8 is a diagram for explaining a reading processing of a print parameter in the printer according to the present embodiment.

In the printer 1, when printing processings to the print media 100 are continuously executed, a head temperature becomes higher than an ambient temperature of the thermal head 6. For example, when the print processings are continuously executed from the state that an ambient temperature of the thermal head 6 and a head temperature are same (for example, the ambient temperature: 20° C., the head temperature: 20° C.), an ambient temperature is kept at the ambient temperature (for example. the ambient temperature: 20° C.) at the time of starting print processing, and does not greatly change, but a head temperature rises from the head temperature at the time of starting print processing.

However, in a conventional printer, the print parameter is selected as a premise that an ambient temperature and a head temperature are same. In the printer like this, even when the printing processings are continuously executed and only the head temperature has risen from 20° C. to 50° C., a print energy necessary for printing an image of a prescribed print density (for example, 50%) is selected as a print parameter, assuming that the ambient temperature also has risen from 20° C. to 50° C. In this case, as shown in FIG. 6, the print energy supplied to the thermal head 6 is smaller than the print energy necessary for printing an image of a prescribed print density (for example, 50%) when the ambient temperature is 20° C. and the head temperature is 50° C. (refer to FIG. 6). For the reason, the head temperature of the thermal head 6 does not rise to a head temperature necessary for transferring the image of the prescribed print density, and thereby the print density might become light.

Accordingly, in the present embodiment, the CPU 201*a* selects a print energy corresponding to an effective head temperature based on the first temperature and the second temperature as a print parameter. By this means, even when the printing processings are continuously executed and only the head temperature rises, since it is possible to select a print energy necessary for printing an image of a prescribed print density, it can be prevented that the head temperature of the thermal head 6 does not rise to a head temperature necessary for transferring the image of the prescribed print density, and the printing density thereof becomes light.

Specifically, the CPU 201*a* obtains a weighted average of the first temperature and the second temperature based on weights which have been previously set to the first temperature and the second temperature respectively, as an effective head temperature. For example, when weights which have been previously set to the first temperature and the second temperature respectively are 1:1, and the first temperature 30° C. and the second temperature 10° C. are detected (refer to FIG. 7), a weighted average of the first temperature and the second temperature becomes (30×1+10×1)/2=20° C. Accordingly, the CPU 201*a* makes the weighted average 20° C. to be an effective head temperature, and as shown in FIG. 7, selects a print energy corresponding to the weighted average 20° C. (a print energy corresponding to the head temperature 20° C. and the ambient temperature 20° C.), as a print parameter.

In addition, when weights which have been previously set to the first temperature and the second temperature respectively are 3:1, and the first temperature 50° C. and the second temperature 10° C. are detected (refer to FIG. 7), a weighted average of the first temperature and the second temperature becomes (50×3+10×1)/4=40° C. Accordingly, the CPU 201*a* makes the weighted average 40° C. to be an effective head temperature, and as shown in FIG. 7, selects a print energy corresponding to the weighted average 40° C. (a print energy corresponding to the head temperature 40° C. and the ambient temperature 40° C.), as a print parameter.

In addition, in the present embodiment, the CPU 201*a* makes a weight of the first temperature further larger than a weight of the second temperature, as the difference between the first temperature and the second temperature becomes larger. By this means, since it is possible to make a weighted average of the first temperature and the second temperature closer to an effective head temperature, it is possible to select a print energy necessary for obtaining an image of a prescribed print density, with higher accuracy.

In the present embodiment, the memory portion 203 stores weights for the first temperatures and the second temperatures, respectively, as shown in FIG. 8, regarding all combinations of the first temperatures (for example, head temperatures from 0° C. to 63° C., in increments of 1° C.) and the second temperatures (for example, ambient temperatures from 0° C. to 63° C., in increments of 1° C.). And, the weight of the first temperature becomes further larger than the weight of the second temperature, as the difference between the first temperature and the second temperature become larger, as shown in FIG. 8.

For example, when the difference between the first temperature and the second temperature is small or the first temperature and the second temperature are equal (for example, a case that the first temperature is 25° C. and the second temperature is 25° C., and so on), the CPU 201*a* reads 1:1 that are weights respectively corresponding to the first temperature and the second temperature. And, the CPU 201*a* makes a weighted average of the first temperature and the second temperature, based on 1:1 that are the relevant read weights, to be an effective head temperature.

On the other hand, when the difference between the first temperature and the second temperature is large (for example, a case that the first temperature is 63° C. and the second temperature is 1° C., a case that the first temperature is 1° C. and the second temperature is 63° C., and so on), the CPU 201*a* reads 1:3, as weights respectively corresponding to the first temperature and the second temperature. And, the CPU 201*a* makes a weighted average of the first temperature and the second temperature, based on 1:3 that are the relevant read weights, to be an effective head temperature.

In this manner, according to the printer 1 of the present embodiment, since it is only necessary that a set of print parameters is stored in the memory portion 203 for each head temperature, it is possible to reduce a storage area of the memory portion 203 necessary for storing the print parameters. In addition, even when the printing processings are continuously executed and only the head temperature rises, since the print processing can be executed in accordance with the print parameter necessary for printing an image of a prescribed print density, it can be prevented that the head temperature of the thermal head 6 does not rise to a head temperature necessary for transferring the image of the prescribed print density, and the printing density thereof becomes light.

In the present embodiment, the printer 1 of a heat melting type printing system using the intermediate transfer film 8 has been described, but the present embodiment can be applied similarly to a printer which thermally transfers an image directly to the print media 100 using only the thermal transfer ink ribbon 7, without using the intermediate transfer film 8.

In the present embodiment, the CPU 201*a* obtains a weighted average of the first temperature and the second temperature based on weights which have been previously set to the first temperature and the second temperature respectively as an effective head temperature, but without being limited to this, effective head temperatures corresponding to all combinations of the first temperatures and the second temperatures may be previously set, for example.

Further, the program to be executed in the printer 1 of the present embodiment is presented with being incorporated previously in a ROM and so on, but is not limited to this. The program to be executed in the printer 1 of the present embodiment may be configured such that the program is presented with being stored in a computer readable recording medium, such as a CD-ROM, a flexible disk (FD), a CD-R, a DVD (Digital Versatile Disk) in a file form of an installable format or an executable format.

Further, the program to be executed in the printer 1 of the present embodiment may be configured such that the program is stored on a computer connected to a network such as Internet, and is presented by being downloaded through the network. In addition, the program to be executed in the printer 1 of the present embodiment may be configured such that the program is provided or distributed through a network such as Internet.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a printing portion to perform printing using a thermal head;

a first detecting portion to detect a first temperature that is a head temperature of the thermal head;

a second detecting portion to detect a second temperature that is an ambient temperature of the thermal head;

a memory portion to store control conditions of the thermal head, each of which is determined for each of the head temperatures under the one ambient temperature; and a controller which reads the control condition corresponding to an effective head temperature based on the first temperature and the second temperature, from the memory portion, and controls the thermal head in accordance with the relevant read control condition, wherein the controller obtains a weighted average of the first temperature and the second temperature based on weights which have been previously set to the first temperature and the second temperature, respectively, as the effective head temperature.

2. The printer of claim 1, wherein the controller makes the weight of the first temperature further larger than the weight of the second temperature, as the difference between the first temperature and the second temperature becomes larger.

3. A control method of a printer comprising:

detecting a first temperature that is a head temperature of a thermal head used for printing;

detecting a second temperature that is an ambient temperature of the thermal head;

reading, from a memory portion to store control conditions of the thermal head, each of which is determined for each of the head temperatures under the one ambient temperature, the control condition corresponding to an effective head temperature based on the first temperature and the second temperature, and controlling the thermal head in accordance with the relevant read control condition, and obtaining a weighted average of the first temperature and the second temperature based on weights which have been previously set to the first temperature and the second temperature, respectively, as the effective head temperature.

* * * * *